United States Patent [19]

Glazer

[11] 3,997,750

[45] Dec. 14, 1976

[54] WATERPROOF SWITCH

[76] Inventor: Ira M. Glazer, 4930 Jackson St., Hollywood, Fla. 33021

[22] Filed: Apr. 9, 1975

[21] Appl. No.: 566,388

[52] U.S. Cl. ..... 200/302; 200/331

[51] Int. Cl.[2] ..... H01H 9/04

[58] Field of Search ..... 200/153 G, 302, 330, 200/331, 34, 296, 293, 294

[56] References Cited

UNITED STATES PATENTS

| | | | |
|---|---|---|---|
| 2,180,501 | 11/1939 | Blood | 200/330 |
| 2,289,108 | 7/1942 | Eaton | 200/302 |
| 2,878,348 | 3/1959 | Haydon | 200/302 |
| 3,281,565 | 10/1966 | Grady | 200/330 |

*Primary Examiner*—Gerald P. Tolin
*Attorney, Agent, or Firm*—Henry L. Brinks; Jerold A. Jacover

[57] ABSTRACT

A waterproof switching apparatus is disclosed. The apparatus comprises a switch, which is protected by an enclosure having a surface defining a passage for means for actuating the switch. The surface is positioned downwardly from the switch to prevent water from flowing through the passage and into the enclosure.

6 Claims, 3 Drawing Figures

FIG. 1
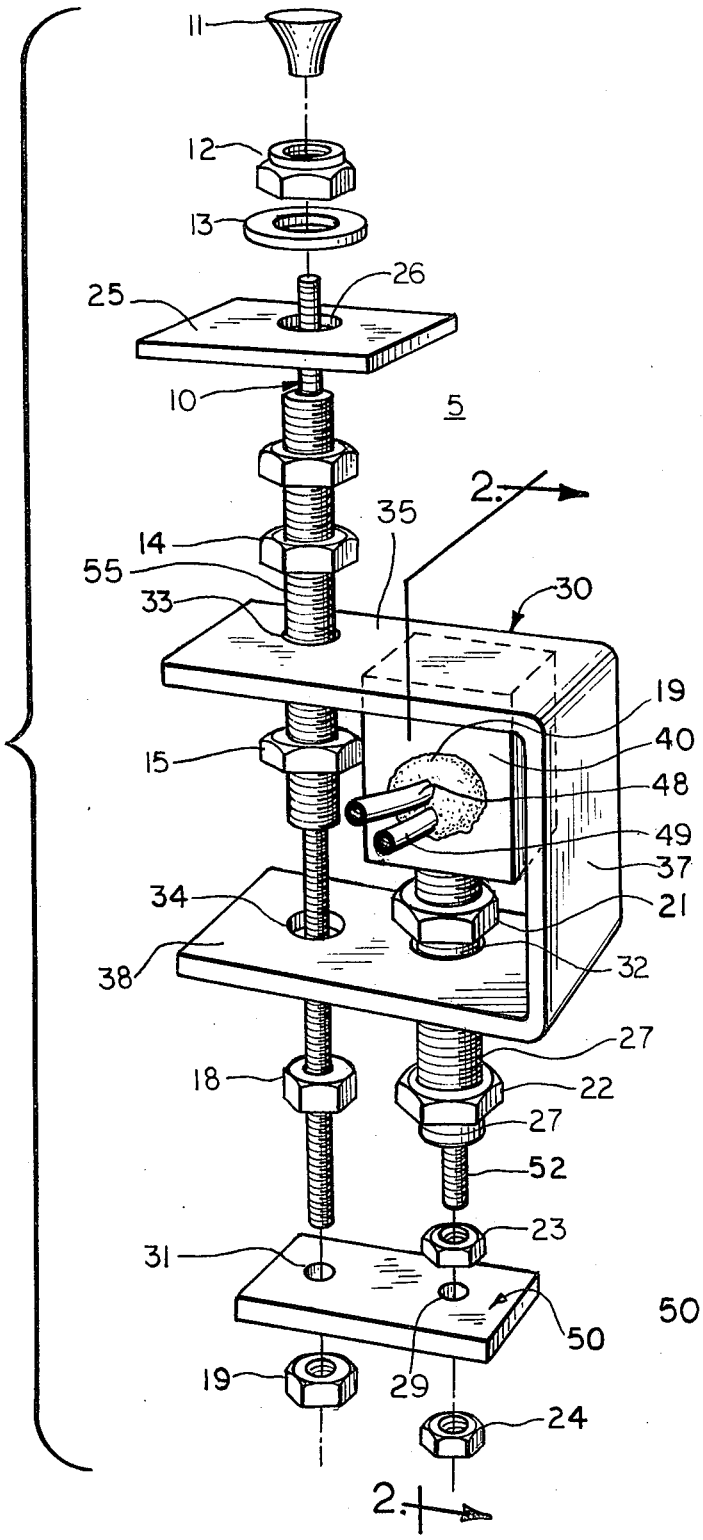
FIG. 2
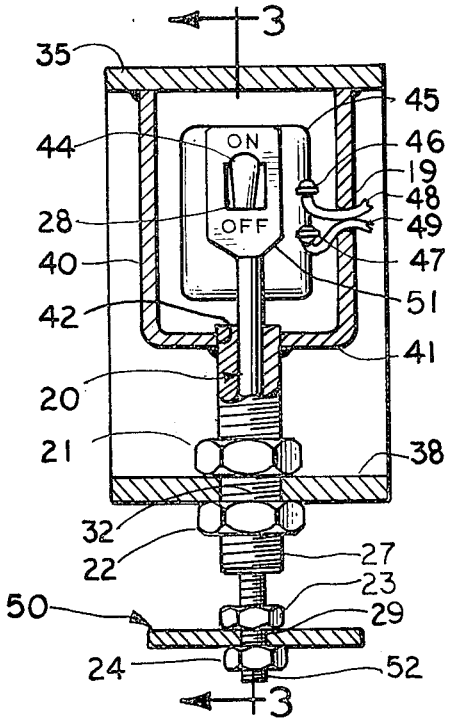
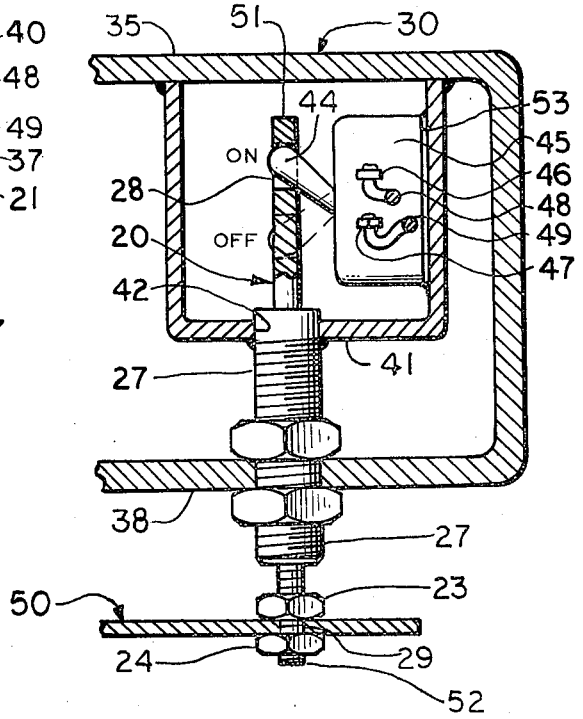
FIG. 3

WATERPROOF SWITCH

BACKGROUND OF THE INVENTION

This invention generally relates to a waterproof switch having contacts sufficiently insulated from spurious water sources to prevent short-circuiting, corrosion, or any other problems that may result from subjecting the contacts to water. Switches of the type described thus find wide use in marine applications or any other situations wherein the switch contacts are susceptible to becoming wet.

Though numerous devices for protecting a switching mechanism from water have been previously disclosed, such prior art switching mechanisms are often subject to numerous drawbacks and deficiencies. For example, some of the prior art switching mechanisms are cumbersome to operate or inefficient, while others are of relatively complex construction and expensive. Accordingly, it is a primary object of this invention to provide an improved waterproof switch. More particularly, it is the object of this invention to provide a relatively inexpensive, yet effective, waterproof switching mechanism which can be readily assembled, installed and operated.

SUMMARY OF THE INVENTION

The foregoing objects, along with various features and advantages of the invention are provided in a waterproof switching apparatus comprising means performing the function of a switch, means for actuating the switch means, and means for enclosing the switch means having a surface defining a passage for the actuation means which is positioned downwardly from the switch means. The waterproof switching apparatus may further comprise mechanical means, operatively coupled to the actuation means, having a portion positioned upwardly from at least a portion of the actuation means. As a result, the switching means are effectively protected from water originating from any spurious source.

BRIEF DESCRIPTION OF THE DRAWINGS

The invention summarized above can be best understood by reading the following detailed description in conjunction with the accompanying drawings in which:

FIG. 1 is an exploded, perspective view, partially cutaway, of a waterproof switching mechanism embodying the invention;

FIG. 2 is a sectional view taken along lines 2—2 of FIG. 1; and

FIG. 3 is a sectional view taken along lines 3—3 of FIG. 2.

DETAILED DESCRIPTION OF AN EXEMPLARY EMBODIMENT

Referring now to the drawings, an exemplary embodiment of the waterproof switching apparatus of the invention is represented generally by reference numeral 5. Switching apparatus 5 includes an enclosure 40 having a bottom portion 41 defining an aperture 42 shown best in FIGS. 2 and 3. Secured inside enclosure 40 by any suitable means such as an adhesive 53 are means performing the function of a switch such as a single-pole, single-throw toggle switch 45. For reasons that will be more apparent hereinafter, switch 45 is positioned above bottom portion 41 to prevent water from flowing through aperture 42 and interfering with the proper operation of switch 45.

In this exemplary embodiment, switch 45 is characterized by a projecting lever 44 conventionally movable into either an ON or an OFF position, and typically includes a pair of terminals 46, 47 having a pair of electrical conductors 48, 49 coupled, respectively, thereto. Conductors 48, 49 are adapted to form part of an electrical circuit (not shown) which can be opened or closed depending on the position of projecting lever 44 of switch 45. More particularly, when projecting lever 44 is moved into the ON position, this has the effect of connecting terminals 46, 47, thereby closing the circuit comprising electrical conductors 48, 49. On the other hand, when projecting lever 44 is moved to the OFF position, this has the effect of disconnecting terminals 46, 47, thereby opening the circuit comprising electrical conductors 48, 49. Though, as explained above, switch 45 comprises a single-pole, single-throw toggle switch, it should be emphasized that many other switching devices could be used, and therefore the toggle switch illustrated in the drawings and described herein is intended to be exemplary, and should not be construed as limitative.

In this exemplary embodiment, means are further provided for actuating switch 45, such as by alternately moving projecting lever 44 to its ON or OFF position. Such actuation means may include, for example, a first rigid vertical member 20 having an upper end 51 defining an aperture 28 for receiving projecting lever 44, and a lower threaded end 52. Thus, when an upward force is applied to first vertical member 20, upper end 51 defining aperture 28 forces projecting lever 44 to its ON position. However, when a downward force is applied to first vertical member 20, upper end 51 forces projecting lever 44 to its OFF position.

As shown in the drawings, first vertical member 20 protrudes through enclosure 40 via aperture 42 in bottom surface 41. Electrical conductors 48, 49 also pass outside of enclosure 40 preferably through a sidewall thereof which is then resealed with waterproof cement 19 or similar means.

Referring now primarily to FIG. 1, support means in the form of a C-shaped bracket 30 are shown. Bracket 30 has a top portion 35 defining an aperture 33, a side portion 37, and a bottom 38 defining a pair of apertures 34, 32. Bracket 30 is adapted to support enclosure 40 by attaching the top surface thereof to the bottom surface of top portion 35.

As explained above, and as shown in the figures, first vertical member 20 extends downwardly from enclosure 40. Surrounding at least a portion of first vertical member 20 is a first threaded nipple 27. First nipple 27 is of sufficient diameter to permit a portion of first vertical member 20 to move through first nipple 27 without substantial friction. First nipple 27 is adapted to pass through aperture 32 in bottom portion 38, and is secured thereto by a pair of nuts 21, 22. More particularly, nuts 21, 22 are threaded along first nipple 27 until they are brought into tight frictional engagement with the upper and lower surfaces, respectively, of lower portion 38 of bracket 30. As a result, first nipple 27 with first vertical member 20 passing therethrough, is tightly secured to bracket 30.

Switching apparatus 5 further includes mechanical means comprising a second vertical member 10 and a horizontal linkage 50. Linkage 50 has a pair of apertures 29, 31 disposed at each end thereof. Passing through aperture 29 of linkage 50 is threaded end 52 of first vertical member 20. A pair of nuts 23, 24 are threaded along the threaded end 52 of first vertical member 20 until tight frictional contact is made with the upper and lower surfaces, respectively, of linkage 50. In this manner, linkage 50 is securely fastened to first vertical member 20.

A second vertical member 10, which is preferably threaded throughout its entire length, is surrounded at its upper portion by a second threaded nipple 55. Second nipple 55 is of sufficient diameter to permit a portion of second vertical member 10 to move through second nipple 55 without substantial friction. Second nipple 55 is adapted to pass through aperture 33 in top portion 35 of bracket 30, and is secured thereto by a pair of nuts 14, 15. More particularly, nuts 14, 15 are threaded along second nipple 55 until they are brought into tight frictional engagement with the upper and lower surfaces, respectively, of upper portion 35 of bracket 30. Accordingly, second nipple 55, with second vertical member 10 passing therethrough, is tightly secured to bracket 30.

Second vertical member 10 is adapted to pass through aperture 31 in linkage 50 and is securely attached thereto by a pair of nuts 18, 19 in the same manner that nuts 23, 24 secured first vertical member 10 to linkage 50. Second vertical member 10 is similarly adapted to pass through aperture 34 in lower portion 38 of bracket 30, and while surrounded by second nipple 55 passes through aperture 33 of upper portion 35 and an aperture 26 in a finishing member 25. Finishing member 25 may be a face plate, the dashboard of a marine vehicle, or any suitable surface for the installation of switching apparatus 5. It should be noted, however, that finishing member 25 is exemplary only, and is not necessary for the proper operation of switching mechanism 5.

Preferably secured to the uppermost end of second nipple 10 is a washer 13, and a finishing nut 12 shown in FIG. 1. More particularly, finishing nut 12 is threaded along second nipple 55 until it forces washer 13 into tight engagement with the upper surface of finishing member 25. Accordingly, second nipple 55 is tightly secured to finishing surface 25.

Second vertical member 10 extends through second nipple 55, and above finishing member 25, terminating in a push-pull knob 11. Push-pull knob 11 is thus threadedly secured to the uppermost end of second vertical member 10. Accordingly, when a force is applied to knob 11, second vertical member 10, horizontal linkage 50, and first vertical member 20 are necessarily moved in the same direction as the force so applied. For example, if knob 11 is pulled upwardly, second vertical member 10 slides upwardly with respect to second nipple 55, linkage 50 moves upwardly, and first vertical member 20 slides upwardly relative to nipple 27. The upward movement of first vertical member 20 causes projecting lever 44 of switch 45 to be placed in the ON position. As explained above, this effectuates the closure of the circuit comprising conductors 48, 49. On the other hand, if knob 11 is pushed in a downwardly direction, second vertical member 10 slides downward relative to second nipple 55, linkage 50 is urged downwardly and first vertical member 20 moves downwardly relative to first nipple 27. This, in turn, causes projecting lever 44 of switch 45 to be moved to its OFF position, thereby opening the circuit comprising conductors 48, 49.

In view of the foregoing, it should be apparent that switching mechanism 5 desirably performs a switching function. Moreover, if a spurious quantity of water should suddenly engulf switching mechanism 5, it would be very unlikely for switch 45 to be adversely affected since it is protected by enclosure 40. More particularly, it should be observed that the primary access to switch 45 is through aperture 42 which is disposed in the bottom 41 of enclosure 40. Since aperture 42 is substantially sealed by the threaded engagement of nipple 27 with bottom 41, water is substantially precluded from entering enclosure 40. It should also be observed that, since nipple 27 enters enclosure 40 at bottom 41, it wll be highly unlikely that the water will have a sufficient upward force to penetrate the enclosure and reach switch 45.

It should be further observed that, since gravitational forces will prevent any quantity of water from settling on bottom 41, there is little chance that water will eventually seep through aperture 42. Moreover, in the unlikely event that water does enter enclosure 40, it will drip out through aperture 42 before accumulating in sufficient quantities to interfere with the proper operation of switch 45. As a result, switch 45 and contacts 46, 47 are adequately protected from any spurious quantities of water, thereby preventing short-circuiting, corrosion, or other undesirable effects.

Though the exemplary embodiment of the switching apparatus herein described is preferred, it will be readily apparent to those skilled in the art that numerous modifications and refinements can be made without departing from the true scope of the invention. Accordingly, all such refinements and modifications are intended to be covered by the appended claims.

I claim:

1. Waterproof switching apparatus comprising:
a substantially waterproof enclosure having a bottom wall;
an electrical switch with actuator means, said switch secured inside said enclosure above said bottom wall, adapted to be alternately actuated between a first and a second position;
a first member, communicating with said actuator means and extending upwardly through said bottom wall, movable to alternately actuate said switch between said first and said second positions; and
a second member, linked to said first member below said bottom wall and extending upwardly above said bottom wall, operable to move said first member for actuating said switch.

2. The switching apparatus defined in claim 1 wherein the upper end of said second member terminates in a knob, and wherein said apparatus further includes a face plate disposed immediately below said knob.

3. The apparatus defined in claim 1 further includes bracket means supporting said enclosure, and said first member and said second member.

4. The apparatus defined in claim 1 wherein said first member and said second member are of rigid construction and vertical orientation, and are linked together by a rigid linkage.

5. Waterproof switching apparatus comprising:
a substantially waterproof enclosure having a bottom wall;
an electrical switch with actuator means, said switch secured inside said enclosure above said bottom wall, adapted to be alternately actuated between a first and a second position;

a first rigid, vertical member, communicating with said actuator means and extending upwardly through said bottom wall, adapted for reciprocating movement to alternately actuate said switch between said first and said second positions; and a second rigid, vertical member, rigidly linked to said first member below said bottom wall and extending upwardly above said enclosure, terminating in a knob; said knob being accessible to an operator for the application of reciprocative forces thereto; said forces causing said reciprocating movement of said first member for actuating said switch.

6. The switching apparatus defined in claim 5 further includes bracket means supporting said enclosure, said first member and said second member.

* * * * *